US005577615A

United States Patent [19]

Wile et al.

[11] Patent Number: 5,577,615

[45] Date of Patent: Nov. 26, 1996

[54] BAG DISPENSING SYSTEM

[75] Inventors: Richard M. Wile, Medfield; Gregory M. Duval, Taunton; Leighton H. York, Jr., Essex, all of Mass.

[73] Assignee: BPI Packaging Technologies, Inc., North Dighton, Mass.

[21] Appl. No.: 509,971

[22] Filed: Aug. 1, 1995

[51] Int. Cl.[6] ..... B65D 73/00

[52] U.S. Cl. ..... 206/554; 206/459.5; 206/493

[58] Field of Search ..... 206/459.5, 554, 206/493, 495, 806; 383/37; 220/404

[56] References Cited

U.S. PATENT DOCUMENTS

| | | | |
|---|---|---|---|
| 3,738,482 | 6/1973 | Cwikla | 206/554 X |
| 4,493,419 | 1/1985 | Prader et al. | 206/554 |
| 4,805,969 | 2/1989 | Heacock | 206/554 X |
| 5,184,728 | 2/1993 | Wile . | |
| 5,332,097 | 7/1994 | Wile . | |
| 5,405,021 | 4/1995 | Smithson | 206/554 X |

FOREIGN PATENT DOCUMENTS 2234734 2/1991 United Kingdom .

*Primary Examiner*—Jacob K. Ackun
*Attorney, Agent, or Firm*—Henry D. Pahl, Jr.

[57] ABSTRACT

The dispensing system disclosed herein is adapted to dispense T-shirt type plastic film bags of the type having an openable mouth and loop handles extending upward on either side of the mouth, the handles being linked at their upper ends by a tearaway strip extending between them. The stack of bags are retained in a cartridge formed of a stiff web member which is folded to provide front and back panels enclosing the upper ends of the handles and the tearaway strips. The back panel has a tongue which is folded under the tearaway strips and which then extends upward parallel to the front panel. The upwardly extending portion of the tongue also holds a retaining strip provided at the upper end of a resilient apron-like member which extends downwardly covering the mouths of the bags so that a user is directed to extract a bag by grasping its bottom rather than the mouth which can cause several bags to be removed unintentionally. The apron carries advertising text and preferably, also a pad of discount coupons.

4 Claims, 6 Drawing Sheets

BAG DISPENSING SYSTEM

BACKGROUND OF THE INVENTION

The present invention relates to a bag dispensing system and more particularly to such a system which both facilitates the presentation of advertising text and materials and which effectively guides a user to extract individual bags in the desired manner from a pack of bags retained in the system.

The present invention is, to some extent, an improvement over the constructions disclosed and claimed in co-assigned U.S. Pat. No. 5,332,097 issued Jul. 26, 1994 to Richard M. Wile (the '097 patent). The '097 patent discloses two particular embodiments of a cardboard cartridge for retaining a stack of T-shirt type plastic film bags. In each case, the bags provide an openable mouth with loop handles extending upwardly on either side of the mouth. The handles are linked at their upper ends by a tearaway strip extending between them. In the first of these prior art embodiments, which is also illustrated in FIG. 7 herein, a relatively deep cardboard cartridge 13 is employed which fully encloses the bag handles and the mouths of the bags. A relatively large quantity of cardboard was required to construct the cartridge and the appearance was not entirely acceptable to all customers. The '097 patent also discloses a second embodiment, which is also illustrated in FIG. 8 herein, which utilizes a more abbreviated cartridge 75 to contain the upper ends of the handles and the bridging strips extending between them. A problem with this construction, however, is that customers may attempt to remove bags from the pack by grasping the bags at the openable mouth. Attempting to do this will commonly result in more than one bag being pulled away from the pack, with the additional bags typically being wasted. The present invention is directed towards overcoming the above-described problems and also toward facilitating the presentation of advertising materials in a pleasing and effective manner.

BRIEF DESCRIPTION OF THE INVENTION

The bag pack of the present invention employs a stack of T-shirt type plastic film bags, each having an openable mouth and handles extending upwardly on either side of the mouth. The handles are linked at their upper ends by a tearaway strip extending between them. A stiff web member is folded to provide front and back parallel panels bridged at their upper ends by a top panel thereby to form an inverted U-shaped channel which encloses the tearaway strips. The back panel includes a tongue which is folded forward under the tearaway strips to retain them as individual bags are torn downwardly from the pack. A resilient rectangular web member has at its upper end an aperture as least as wide as the tongue providing above the aperture a retaining strip. The back panel tongue, after passing under the tearaway strips, extends upwardly over the retaining strip parallel to the front panel and terminates in a tab extending through a slot in the front panel. The resilient web extends downwardly covering the mouths of the bags and the resilient web can thus act in the manner of an apron inhibiting a user from grasping the bags at the openable mouths. The apron member also provides a convenient vehicle for presenting printed advertising, and can also carry a pad of manufacturer's discount coupons.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
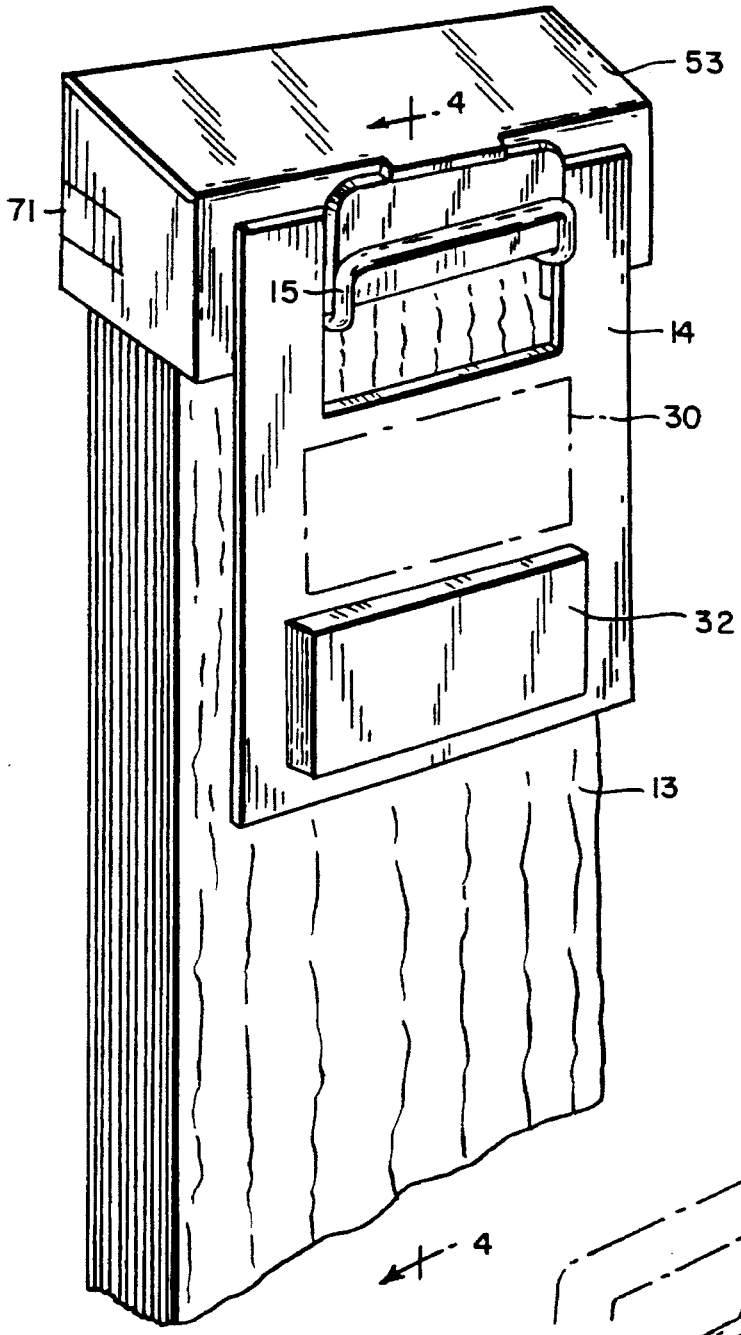
FIG. 1 is a perspective view of a produce bag dispensing system in accordance with the present invention.
Figure 5:
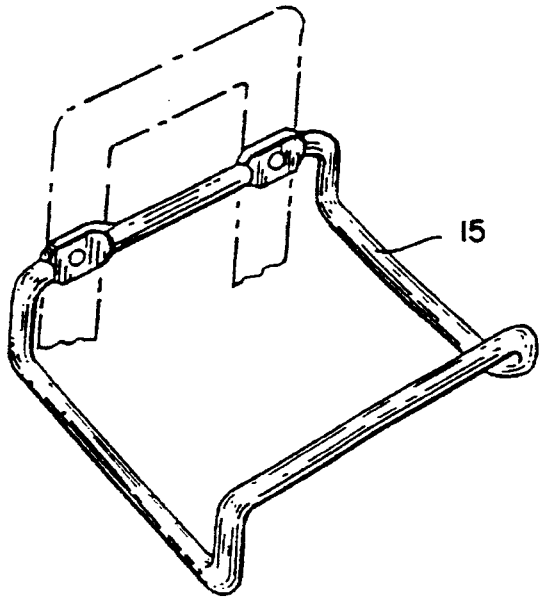
FIG. 5 is a perspective view of a bent wire hook employed in holding the cartridge and bag pack of FIGS. 1 and 4.
Figure 2:
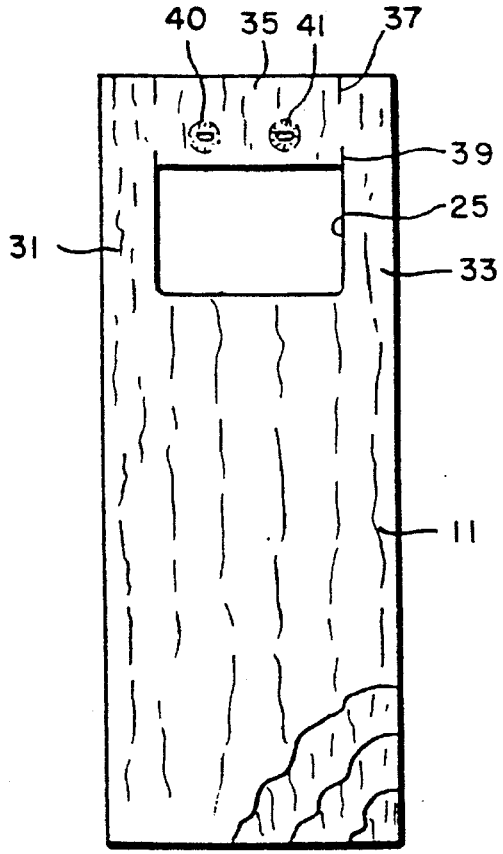
FIG. 2 is a face view of a pack of T-shirt type plastic film bags which can be dispensed using the system of FIG. 1.

Referring now to FIG. 1, a stack of T-shirt type plastic film bags 11 are held for dispensing in a folding boxboard cartridge 13 which is, in turn, mounted on a bent wire hook 15. In accordance with one aspect of the present invention, the cartridge 13 also carries an apron member 14 described in greater detail hereinafter. As indicated, the bags 11 are generally of the T-shirt type and have an outline form as illustrated in FIG. 2.

The bags 11 are preferably formed from a gussetted tube of a suitable plastic film which is heat sealed at intervals to close off the tube at each end of the bag. A preferred form of plastic film material is that disclosed in copending, coassigned application Ser. No. 07/677,534 filed on Mar. 29, 1991 by Dennis N. Caulfield, Eric George and Alex Vaicunas and entitled Polymeric Material And Clear Film Produced Therefrom. The method of forming the bags themselves is also described in greater detail in said copending application Ser. No. 07/677,534 and the disclosure of that application is incorporated herein by reference.

After the heat seals are made, the individual bag blanks are separated and stacked. A central cutout, indicated by reference character 25, is then made and creates an openable bag mouth and leaves handle portions, 31 and 33 respectively, on either side of the mouth. In accordance with one aspect of the present invention, a tearaway strip 35 is left between the handle portions 31 and 33, the strip being partially cut through at each end as indicated by reference characters 37 and 39 so that the bags can easily be torn away from the central strip during dispensing. The central strips 35 in a stack of bags are preferably bonded together, e.g. by hot pins, so as to form the bags into a pack of a convenient number, typically fifty. In FIG. 2, the bonding points are indicated by reference characters 40 and 41.

Figure 3:
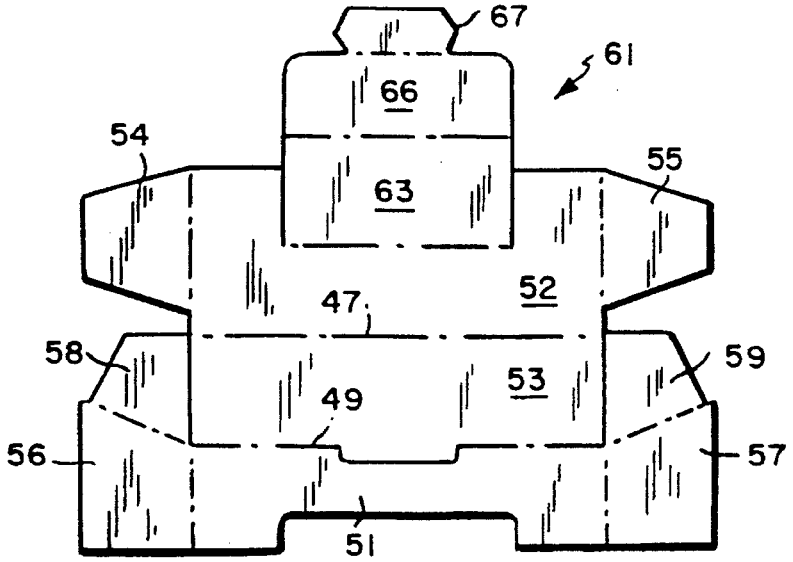
FIG. 3 is an outline view of an unfolded boxboard cartridge employed in the system of FIG. 1.

The cartridge 13 is formed from a corrugated boxboard blank 46 having an outline as shown in FIG. 3. The blank 46 is folded along lines 47 and 49 to provide a front panel 51 which overlies the top portions of the bag handles and a parallel back panel 52, the front and back panels being joined by a top panel 53. Side panels 54 and 55 are folded forward from the back panel 52 and overlying side panels 56 and 57 are folded back from the front panel 51. The sides 56 and 57 extending from the front panel include tabs 58 and 59 which are folded under the top panel 53.

Figure 4:
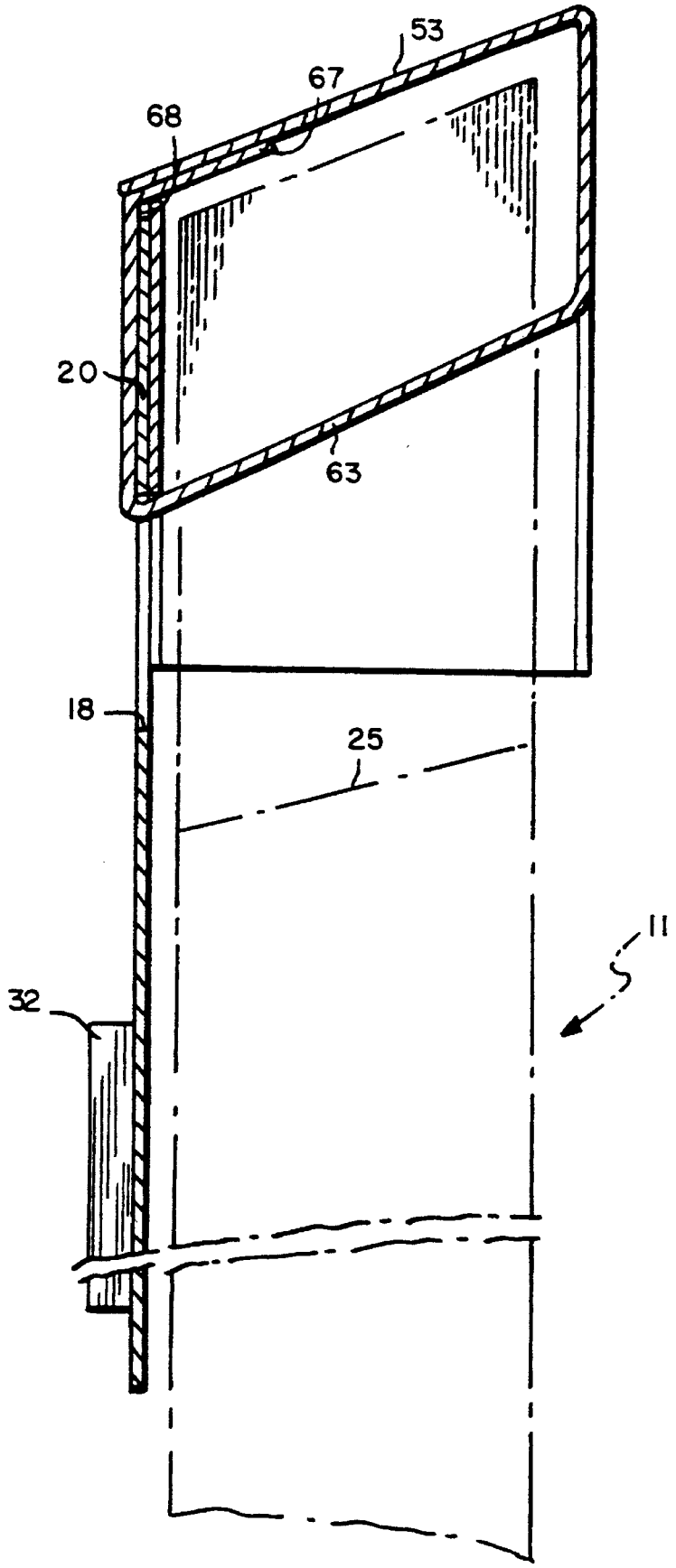
FIG. 4 is a cross-sectional view through the cartridge and bag pack employed in the dispensing system of FIG. 1.
Figure 6:
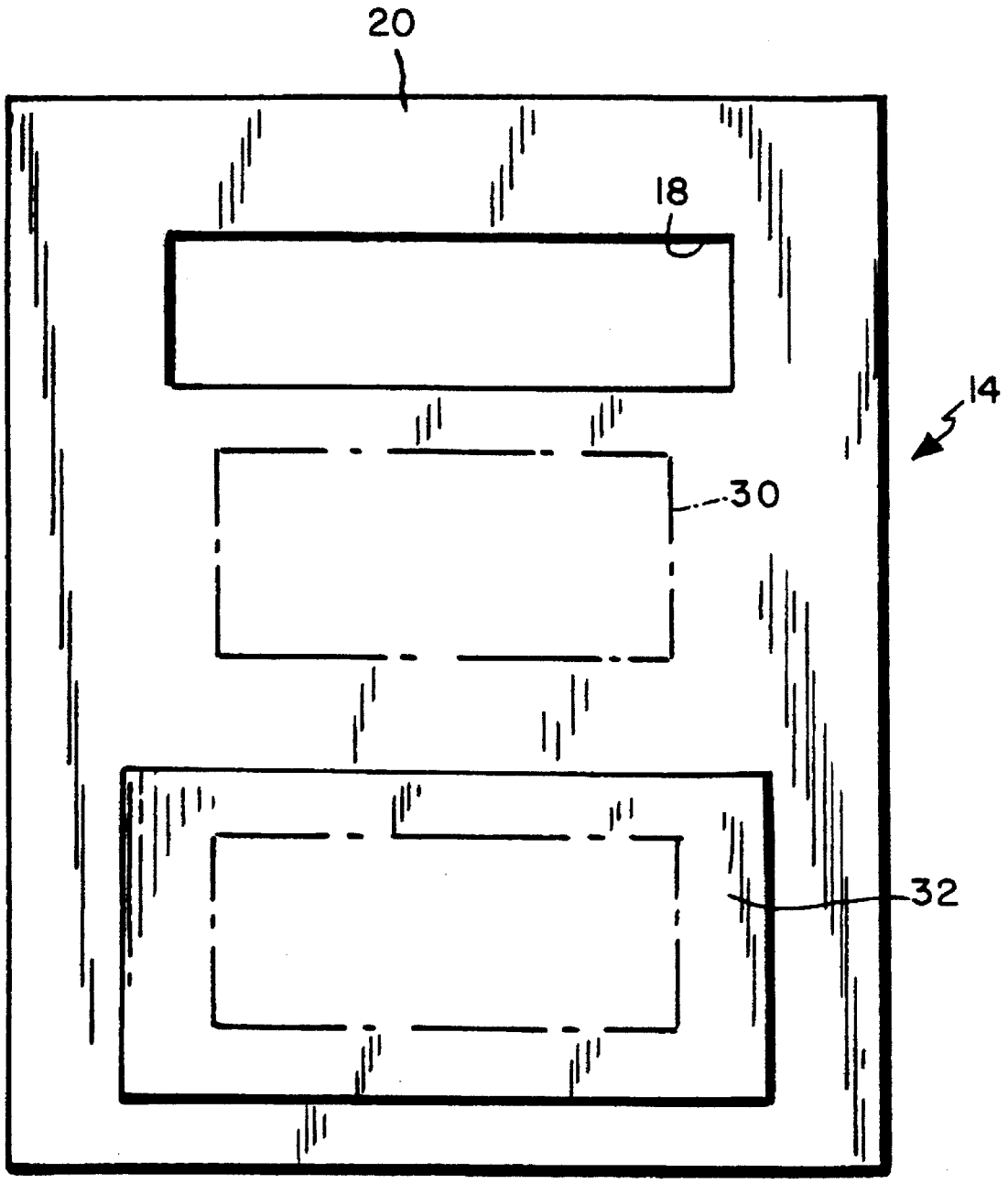
FIG. 6 is a front view of an apron member employed in the system of FIG. 1.
Figure 7:
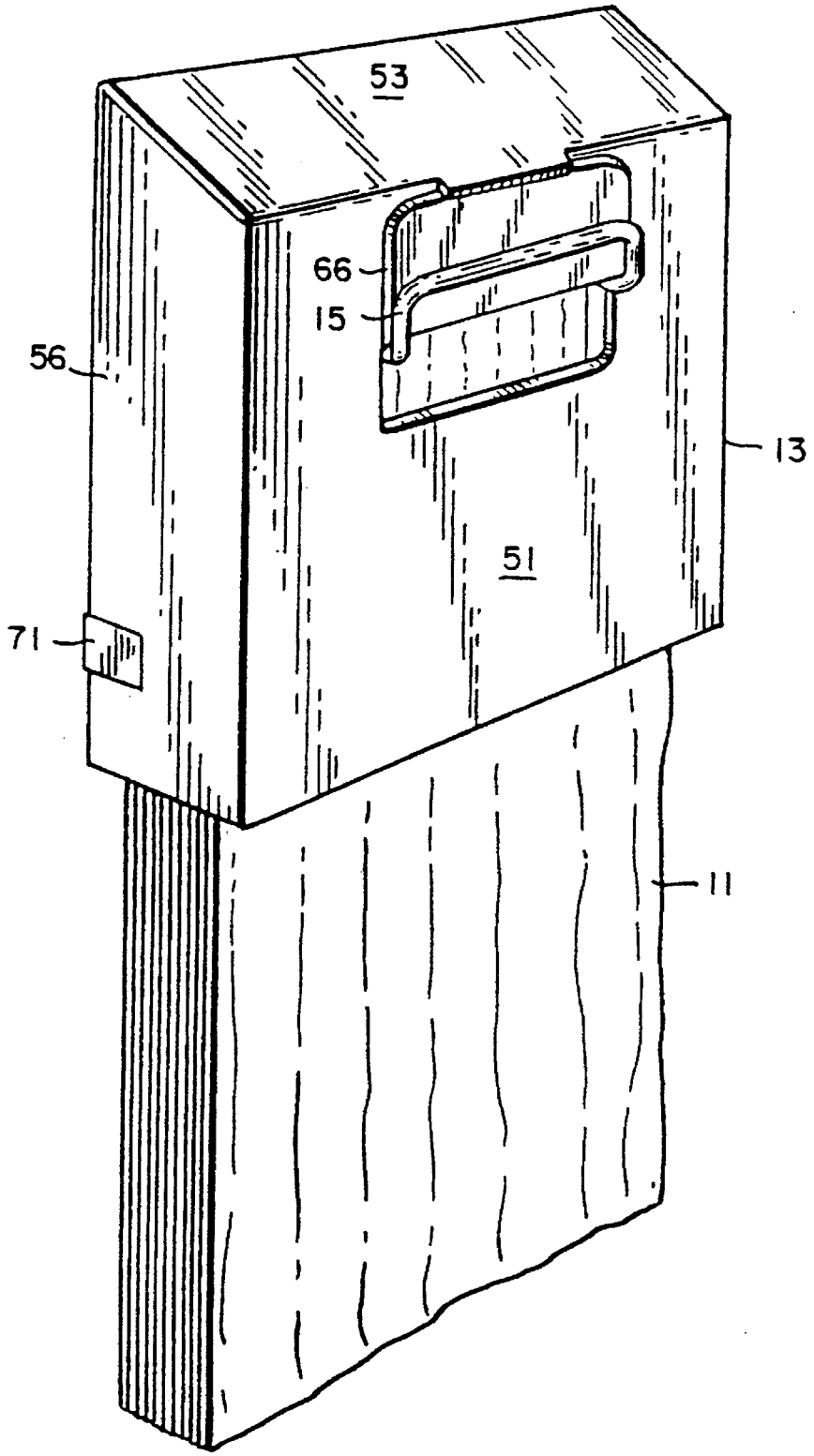
FIG. 7 PRIOR ART
FIG. 7 is a perspective view of a prior art produce bag dispensing system.
Figure 8:
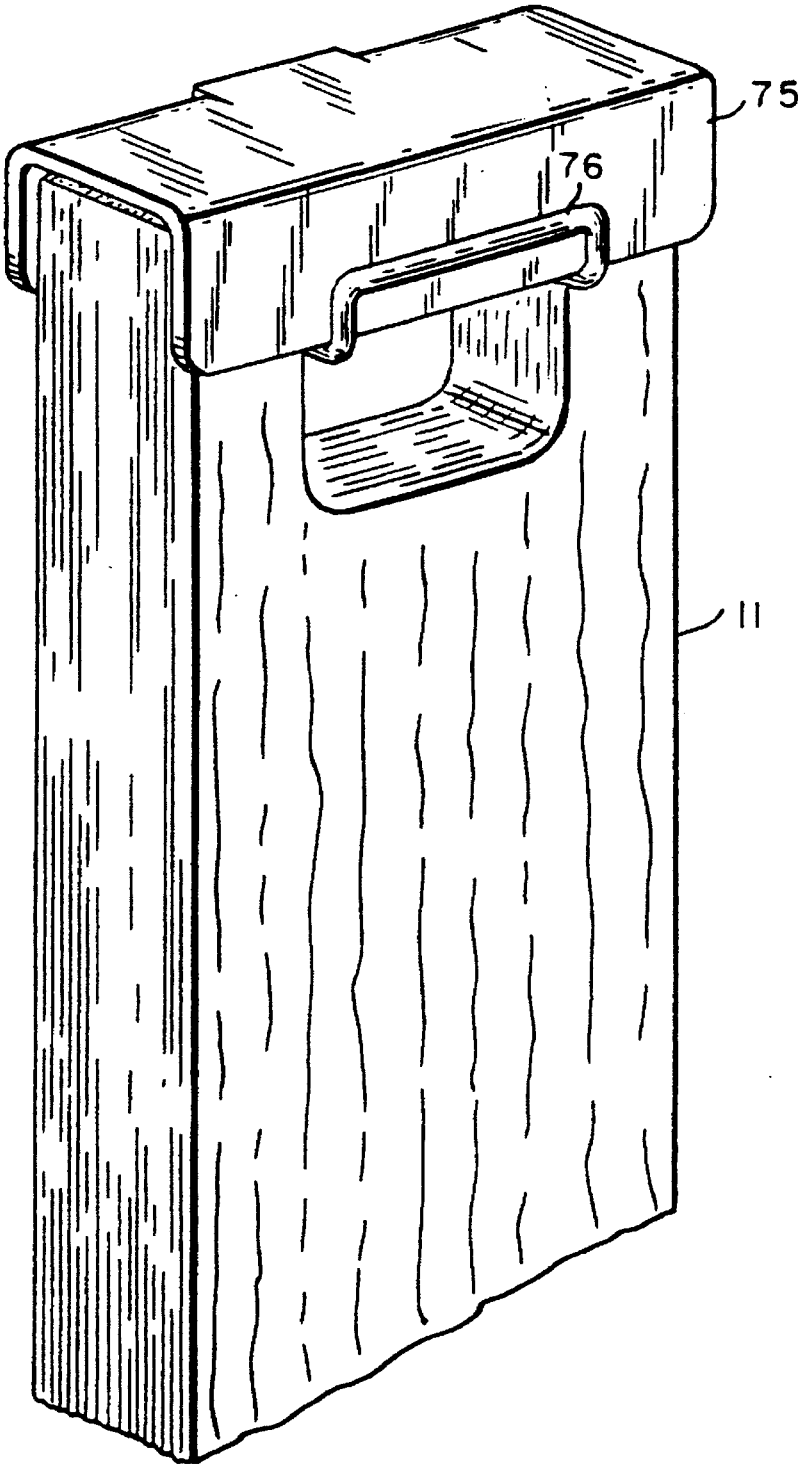
FIG. 8 PRIOR ART
FIG. 8 is a perspective view of another prior art dispensing system.

As illustrated in FIG. 6, the apron member 14 comprises a rectangular piece 16 of a tough resilient web material, e.g. plasticized paperboard, a relatively heavy plastic film or a non-woven material such as Tyvek. A rectangular cutout 18 approximately as wide as the spacing between the bag handles is provided near the upper end of the apron member leaving a retaining strip 20 across the top of the member. The retaining strip 20 overlies the front panel 51 of the cartridge 13 as may be seen in FIGS. 1 and 4.

A large depending tongue portion 61 is cut out from the back panel 52 and is folded so that a portion 63 extends forward under the tearaway strips 35 of a bag pack contained in the cartridge. A further portion 66 is folded up over the retaining strip 20 of the apron member 14 and parallel to the upper portion of the front panel 51 and terminates in a tab portion 67 which extends through a slot 68 cut at the juncture between the front panel 51 and the top panel 53. When the blank 46 is folded as described, it will largely hold itself in assembled position but it is preferably secured by tape strips as indicated at 71 in FIG. 1.

As indicated, the cartridge 13 may be assembled with one or more stacks or packs of the bags 11 held therein, the tearaway strips being retained by the tongue portion 63. In use, the cartridge with contained bag stacks is hung on a wire hook 15 or similar fixture with the hook extending between the bag handles with the bags 11 hanging down from the tearaway strips.

A produce customer desiring to obtain a bag merely grasps the front one below the apron member 14 and pulls down so that the handle portions 31 and 33 separate from the tearaway strip 35. This can typically be accomplished with one hand. The tearaway strips 35 are retained in the cartridge and do not form litter in the produce area. Because of the presence of the apron member 14, the customer is effectively constrained to grasp the front bag near its bottom. The problem of multiple bags being torn away and wasted is thus substantially alleviated as compared with prior art structures in which the bag mouths are exposed.

Further, the face of the apron member provides a suitable fixed large surface for advertising text, as indicated by reference character 30. Not only can this surface be larger than that provided by the prior art cartridge of FIG. 1 but the advertising can be assembled with the pack and cartridge at a late stage in the assembly and a standard cardboard czrtridge blank can be used rather than a custom printed one.

A further advantage of the inclusion of the apron member 14 is that it can carry a pad 32 of coupons, e.g. manufacturer's discount coupons. As will be apparent to those skilled in marketing techniques, the produce section of a supermarket is an ideal place to advertise associable products such as salad dressing. The weight of such a pad 32 is also advantageous in that it helps hold the apron member 14 down in place over the bags.

In view of the foregoing it may be seen that several objects of the present invention are achieved and other advantageous results have been attained.

As various changes could be made in the above constructions without departing from the scope of the invention, it should be understood that all matter contained in the above description or shown in the accompanying drawings shall be interpreted as illustrative and not in a limiting sense.

What is claimed is:

1. A bag pack comprising:

a stack of T-shirt type plastic film bags having a mouth and loop handles extending upwards on either side of the mouth, the handles being linked at their upper ends by a tearaway strip extending between them;

a resilient rectangular web member having at its upper end an aperture approximately as wide as said mouths providing, above said aperture, a retaining strip;

a stiff cardboard web member which is folded to provide a cartridge of tube-like cross-section which encloses said tearaway strips and said retaining strip;

said resilient web carrying advertising and extending downwardly covering the mouths of said bags.

2. A bag pack comprising:

a stack of T-shirt type plastic film bags having a mouth and loop handles extending upwards on either side of the mouth, the handles being linked at their upper ends by a tearaway strip extending between them;

a stiff web member which is folded to provide front and back parallel panels bridged at their upper ends by a top panel thereby to form an inverted U shaped channel which encloses said tearaway strips, said back panel having a tongue which is folded forward under said tearaway strips to retain them as individual bags are torn downwardly from the pack;

a resilient rectangular web member having at its upper end an aperture at least as wide as said tongue providing above said aperture a retaining strip, said tongue, after passing under said tearaway strips, extending upwardly over said retaining strip parallel to said front panel and terminating in a tab extending through a slot in said front panel, said resilient web extending downwardly covering the mouths of said bags.

3. A bag pack comprising:

a stack of T-shirt type plastic film bags having a mouth and loop handles extending upwards on either side of the mouth, the handles being linked at their upper ends by a tearaway strip extending between them;

a stiff web member which is folded to provide front and back parallel panels bridged at their upper ends by a top panel thereby to form an inverted U shaped channel which encloses said tearaway strips and the upper ends of said handles, said back panel having a tongue which is folded forward under said tearaway strips to retain them as individual bags are torn downwardly from the pack;

a resilient web member having at its upper end an aperture at least as wide as said tongue providing above said aperture a retaining strip which overlies said fron panel, said resilient web carrying advertising and extending downwardly covering the mouths of said bags, said tongue, after passing under said tearaway strips, extending upwardly parallel to said front panel over said retaining strip thereby to retain said resilient web member in place.

4. A bag pack comprising:

a stack of T-shirt type plastic film bags having a mouth and loop handles extending upwards on either side of the mouth, the handles being linked at their upper ends by a tearaway strip extending between them;

a stiff cardboard web member which is folded to provide front and back parallel panels bridged at their upper ends by a top panel thereby to form an inverted U shaped channel which encloses said tearaway strips and the upper ends of said handles, said back panel having a tongue which is folded forward under said tearaway strips to retain them as individual bags are torn downwardly from the pack;

a resilient apron member having at its upper end an aperture at least as wide as said tongue providing above said aperture a retaining strip, said tongue, after passing under said tearaway strips, extending upwardly over said retaining strip parallel to said front panel and terminating in a tab extending through a slot in said front panel, said resilient web extending downwardly covering the mouths of said bags; and adjacent the bottom of said apron member, a pad of promotional coupons.

* * * * *